US009797094B2

(12) United States Patent
Luo et al.

(10) Patent No.: US 9,797,094 B2
(45) Date of Patent: Oct. 24, 2017

(54) PAPER AND METHODS OF MAKING PAPER

(71) Applicant: KEMIRA OYJ, Helsinki (FI)

(72) Inventors: Yuping Luo, Duluth, GA (US); Vladimir Grigoriev, Atlanta, GA (US); Chen Lu, Marietta, GA (US); Scott Rosencrance, Douglasville, FL (US)

(73) Assignee: KEMIRA OY J, Helsinki (FI)

( * ) Notice: Subject to any disclaimer, the term of this patent is extended or adjusted under 35 U.S.C. 154(b) by 363 days.

(21) Appl. No.: 14/899,016

(22) PCT Filed: Sep. 26, 2012

(86) PCT No.: PCT/IB2012/002822

§ 371 (c)(1),
(2) Date: Dec. 16, 2015

(87) PCT Pub. No.: WO2013/046060

PCT Pub. Date: Apr. 4, 2013

(65) Prior Publication Data

US 2016/0153146 A1 Jun. 2, 2016

Related U.S. Application Data

(60) Provisional application No. 61/541,717, filed on Sep. 30, 2011.

(51) Int. Cl.

| | |
|---|---|
| ***D21H 17/55*** | (2006.01) |
| ***D21H 17/56*** | (2006.01) |
| ***D21H 21/18*** | (2006.01) |
| ***D21H 21/20*** | (2006.01) |
| ***D21H 17/00*** | (2006.01) |
| ***D21H 23/04*** | (2006.01) |

(52) U.S. Cl.
CPC ..... *D21H 17/55* (2013.01); *D21H 17/56* (2013.01); *D21H 17/72* (2013.01); *D21H 21/18* (2013.01); *D21H 21/20* (2013.01); *D21H 23/04* (2013.01)

(58) Field of Classification Search
CPC ..... D21H 21/20; D21H 21/18; D21H 17/55; D21H 17/56; D21H 17/72; D21H 17/37; D21H 23/04; D21H 17/47; D21H 17/54; D21H 17/71
See application file for complete search history.

(56) References Cited

U.S. PATENT DOCUMENTS

| | | | | |
|---|---|---|---|---|
| 3,197,427 | A * | 7/1965 | Schmalz | C08G 59/02 524/284 |
| 3,311,594 | A * | 3/1967 | Earle, Jr. | C08G 59/10 162/164.3 |
| 3,442,754 | A * | 5/1969 | Espy | C08K 5/17 162/164.3 |
| 3,556,933 | A * | 1/1971 | Williams et al. | D21H 17/39 162/167 |
| 5,427,652 | A | 6/1995 | Darlington et al. | |
| 5,674,362 | A | 10/1997 | Underwood et al. | |
| 6,222,006 | B1 * | 4/2001 | Kokko | C08G 73/0286 162/157.6 |
| 6,429,267 | B1 | 8/2002 | Riehle | |
| 6,554,961 | B1 * | 4/2003 | Riehle | C08G 73/022 162/164.3 |
| 6,824,648 | B2 * | 11/2004 | Edwards | D21F 11/006 162/111 |
| 7,034,087 | B2 * | 4/2006 | Hagiopol | C08F 8/28 525/329.4 |
| 7,081,512 | B2 * | 7/2006 | Riehle | C08G 73/0286 162/164.3 |
| 7,119,148 | B2 * | 10/2006 | Hagiopol | C08F 8/28 525/327.1 |
| 7,175,740 | B2 * | 2/2007 | Riehle | C08G 73/022 162/164.3 |
| 7,488,403 | B2 * | 2/2009 | Hagiopol | C08F 220/56 162/158 |
| 7,589,153 | B2 * | 9/2009 | Hagiopol | C08L 33/26 162/164.6 |
| 7,863,395 | B2 * | 1/2011 | Hagiopol | C08F 20/56 525/329.4 |
| 7,897,013 | B2 * | 3/2011 | Hagiopol | C08F 220/56 162/158 |
| 9,212,453 | B2 * | 12/2015 | Luo | D21H 17/55 |
| 9,388,533 | B2 * | 7/2016 | Krapsch | D21C 5/02 |
| 9,506,196 | B2 * | 11/2016 | Hagiopol | D21H 21/20 |
| 9,556,562 | B2 * | 1/2017 | Luo | D21H 17/72 |
| 2004/0266984 | A1 * | 12/2004 | Riehle | C08G 73/0286 528/421 |
| 2005/0006042 | A1 * | 1/2005 | Riehle | C08G 73/022 162/164.3 |
| 2005/0187356 | A1 * | 8/2005 | Hagiopol | C08F 8/28 525/329.4 |
| 2006/0037727 | A1 * | 2/2006 | Hagiopol | C08F 220/56 162/168.3 |
| 2006/0041085 | A1 * | 2/2006 | Hagiopol | C08F 8/28 525/379 |
| 2006/0270801 | A1 * | 11/2006 | Hagiopol | C08L 33/26 525/218 |
| 2007/0137821 | A1 * | 6/2007 | Riehle | C08G 73/022 162/164.6 |

(Continued)

FOREIGN PATENT DOCUMENTS

| | | | | |
|---|---|---|---|---|
| FI | WO 2013046060 | A1 * | 4/2013 | D21H 17/55 |
| NL | WO 9222601 | A1 * | 12/1992 | C08G 69/48 |
| WO | 9521298 | A1 | 8/1995 | |
| WO | WO 9933901 | A1 * | 7/1999 | C08G 73/02 |
| WO | 9950500 | A1 | 10/1999 | |
| WO | WO-2008/036241 | A1 | 3/2008 | |
| WO | WO-2010/059946 | A1 | 5/2010 | |

OTHER PUBLICATIONS

Later Publication of Revised Version of International Search Report for PCT/IB2012/002822 dated May 13, 2013.
European Search Report issued by the European Patent Office in relation to European Patent Application No. 17 17 4548 dated Aug. 10, 2017 (2 pages).

*Primary Examiner* — Jose Fortuna
(74) *Attorney, Agent, or Firm* — Robert P. Michal, Esq.; Carter, DeLuca, Farrell & Schmidt, LLP

(57) ABSTRACT

Exemplary embodiments of the present disclosure include paper, methods of making paper, and the like.

8 Claims, 1 Drawing Sheet

(56) References Cited

U.S. PATENT DOCUMENTS

| | | | | |
|---|---|---|---|---|
| 2009/0165978 | A1* | 7/2009 | Hagiopol | C08F 220/56 162/168.3 |
| 2011/0263814 | A1* | 10/2011 | Riehle | C08G 73/022 528/502 A |
| 2012/0186764 | A1* | 7/2012 | McKay | D21H 17/375 162/164.6 |
| 2013/0081771 | A1* | 4/2013 | Luo | D21H 17/55 162/164.6 |
| 2014/0284011 | A1* | 9/2014 | Krapsch | D21C 5/02 162/168.3 |
| 2016/0047090 | A1* | 2/2016 | Crisp | D21H 21/20 162/164.3 |
| 2016/0115315 | A1* | 4/2016 | Ringold | C08L 33/26 523/447 |
| 2016/0153146 | A1* | 6/2016 | Luo | D21H 17/55 162/164.3 |
| 2016/0281300 | A9* | 9/2016 | Lu | D21H 17/47 |
| 2016/0368832 | A1* | 12/2016 | Ringold | C05G 3/0029 |

* cited by examiner

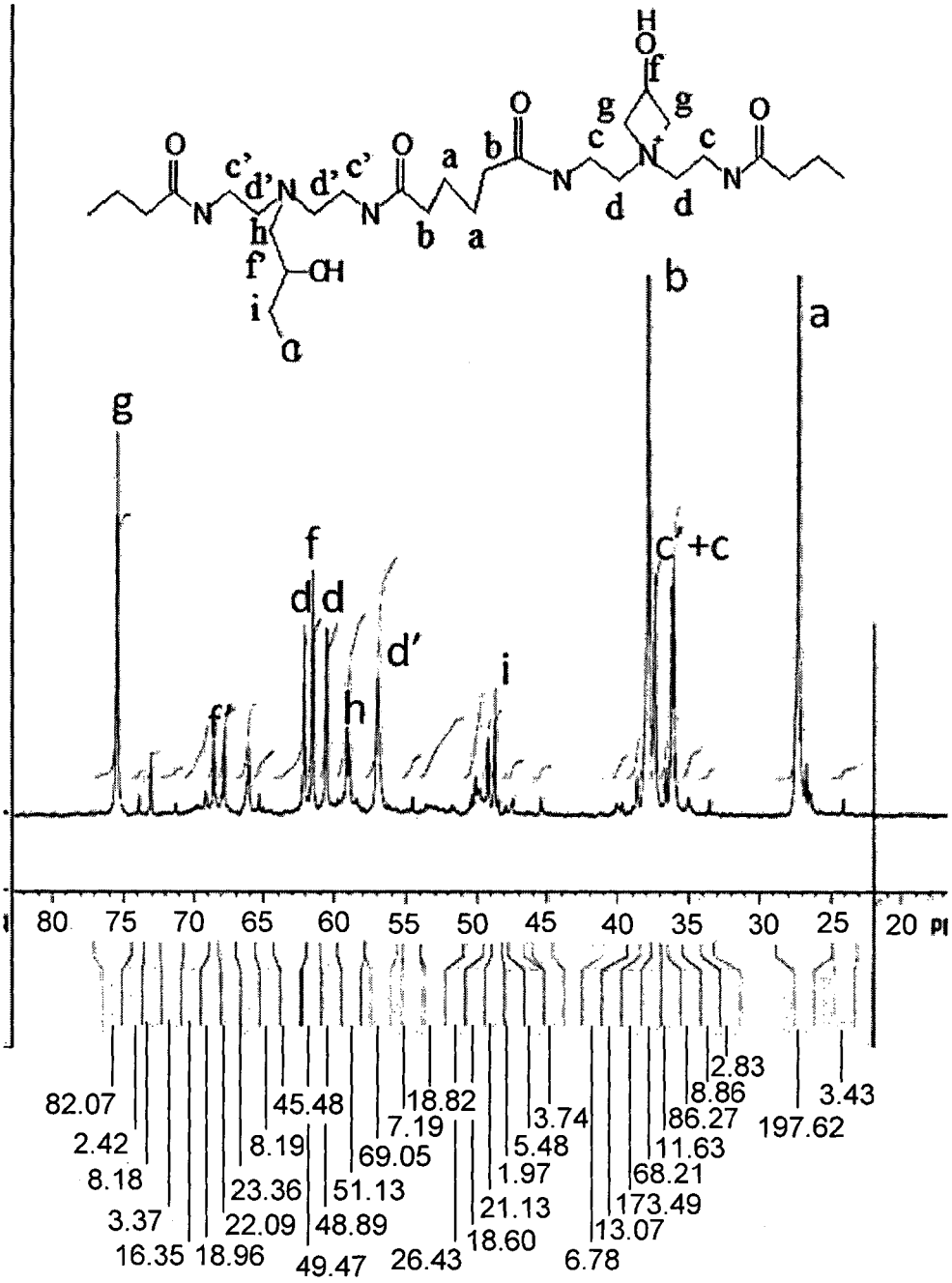
g
f
d d
d'
h
f'
i
b
c'+c
a
80 75 70 65 60 55 50 45 40 35 30 25 20
82.07
2.42
8.18
3.37
16.35
18.96
22.09
23.36
8.19
45.48
48.89
49.47
51.13
69.05
7.19
18.82
26.43
18.60
21.13
1.97
5.48
3.74
6.78
13.07
173.49
68.21
11.63
86.27
8.86
2.83
197.62
3.43

PAPER AND METHODS OF MAKING PAPER

CROSS-REFERENCE TO RELATED APPLICATION

This application is the 35 U.S.C. §371 national stage application of PCT Application No. PCT/IB2012/002822, filed Sep. 26, 2012, which claims priority to U.S. Provisional Application entitled "PAPER AND METHODS OF MAKING PAPER" having Ser. No. 61/541,717, filed on Sep. 30, 2011, both of which are incorporated herein by reference.

BACKGROUND

1. Field of the Art

The present embodiments relate to paper and paper making.

2. Description of Related Art

Paper is sheet material containing interconnected small, discrete fibers. The fibers are usually formed into a sheet on a fine screen from a dilute water suspension or slurry. Paper typically is made from cellulose fibers, although occasionally synthetic fibers are used.

Paper products made from untreated cellulose fibers lose their strength rapidly when they become wet, i.e., they have very little wet strength.

Wet strength resins applied to paper may be either of the "permanent" or "temporary" type, which are defined, in part, by how long the paper retains its wet strength after immersion in water.

Commercially available epichlorohydrin-based wet strength resins are typically prepared by reaction of epichlorohydrin in aqueous solution with polymers containing secondary amino groups. Not all of the epichlorohydrin in the aqueous reaction mixture reacts with the amine groups to functionalize the polymer. Some of the epichlorohydrin remains unreacted, some reacts with water to form 3-chloropropane-1,2-diol, and some reacts with chloride ion to form dichloropropanol, normally a mixture of 1,3-dichloro-2-propanol and 2,3-dichloro-1-propanol. These organic chloride by-products are generally considered to be environmental pollutants, and increasing environmental concerns have created an interest in wet strength resins that have reduced levels of such by-products. As a result, paper makers and chemical suppliers have been working to find alternatives to conventional epichlorohydrin-based wet strength resins with high levels of chloroorganic residuals, or to find alternative methods of reducing the levels of the epi by-products.

The description herein of certain advantages and disadvantages of known methods and compositions is not intended to limit the scope of the present disclosure. Indeed the present embodiments may include some or all of the features described above without suffering from the same disadvantages.

SUMMARY

In view of the foregoing, one or more embodiments include paper, methods of making paper, and the like.

At least one embodiment provides a paper formed by a method including: treatment of an aqueous pulp slurry with an aldehyde-functionalized polymer resin and a polyamidoamine epihalohydrin resin, wherein the aldehyde-functionalized polymer resin to polyamidoamine epihalohydrin resin ratio is about 1:1 or more, and wherein the polyamidoamine epihalohydrin resin has an azetidinium content of about 80% or less. In another embodiment, the polyamidoamine epihalohydrin resin has a total AOX level of about 400 ppm or less.

At least one embodiment provides a paper formed by a method including treatment of an aqueous pulp slurry with an aldehyde-functionalized polymer resin and a polyamidoamine epihalohydrin resin, wherein the aldehyde-functionalized polymer resin to polyamidoamine epihalohydrin resin ratio is about 1:1 or more, and wherein the polyamidoamine epihalohydrin resin has a total AOX level of about 400 ppm or less.

At least one embodiment provides a method of making a paper including: introducing to an aqueous pulp slurry an aldehyde-functionalized polymer resin and a polyamidoamine epihalohydrin resin, wherein the ratio of aldehyde-functionalized polymer resin to polyamidoamine epihalohydrin resin is about 1:1 or more, and wherein the polyamidoamine epihalohydrin resin has an azetidinium content of about 80% or less. In another embodiment, the polyamidoamine epihalohydrin resin has a total AOX level of about 400 ppm or less.

At least one embodiment provides a method of making a paper including: introducing to a pulp slurry an aldehyde-functionalized polymer resin and a polyamidoamine epihalohydrin resin, wherein the ratio of aldehyde-functionalized polymer resin to polyamine polyamidoamine epihalohydrin resin is greater than about 1:1, and wherein the polyamidoamine epihalohydrin resin has a total AOX level of about 400 ppm or less

BRIEF DESCRIPTION OF THE DRAWINGS

In order to facilitate a fuller understanding of the exemplary embodiments, reference is now made to the appended drawings. These drawings should not be construed as limiting, but are intended to be exemplary only.

FIG. 1 illustrates a 13C NMR spectrum that shows the chemical shifts of a PAE resin Example 1.

DETAILED DESCRIPTION OF THE EMBODIMENTS

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, synthetic organic chemistry, paper chemistry, and the like, which are within the skill of the art. Such techniques are explained fully in the literature.

The examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms and phrases that shall be defined to have the following meanings unless a contrary intention is apparent.

Definitions

The term "substituted" refers to any one or more hydrogens on the designated atom or in a compound that can be replaced with a selection from the indicated group, provided that the designated atom's normal valence is not exceeded, and that the substitution results in a stable compound.

"Acrylamide monomer" refers to a monomer of formula: $H_2C{=}C(R_1)C(O)NHR_2$, wherein $R_1$ is H or $C_1$-$C_4$ alkyl and $R_2$ is H, $C_1$-$C_4$ alkyl, aryl or arylalkyl. Exemplary acrylamide monomers include acrylamide and methacrylamide.

"Aldehyde" refers to a compound containing one or more aldehyde (—CHO) groups, where the aldehyde groups are capable of reacting with the amino or amido groups of a polymer comprising amino or amido groups as described herein. Exemplary aldehydes can include formaldehyde, paraformaldehyde, glutaraldehyde, glyoxal, and the like.

"Aliphatic group" refers to a saturated or unsaturated, linear or branched hydrocarbon group and encompasses alkyl, alkenyl, and alkynyl groups, for example.

"Alkyl" refers to a monovalent group derived from a straight or branched chain saturated hydrocarbon by the removal of a single hydrogen atom. Exemplary alkyl groups include methyl, ethyl, n- and iso-propyl, cetyl, and the like.

"Alkylene" refers to a divalent group derived from a straight or branched chain saturated hydrocarbon by the removal of two hydrogen atoms. Exemplary alkylene groups include methylene, ethylene, propylene, and the like.

"Amido group" or "amide" refer to a group of formula —$C(O)NHY_1$ where $Y_1$ is selected from H, alkyl, alkylene, aryl and arylalkyl.

"Amino group" or "amine" refer to a group of formula —$NHY_2$ where $Y_2$ is selected from H, alkyl, alkylene, aryl, and arylalkyl.

"Aryl" refers to an aromatic monocyclic or multicyclic ring system of about 6 to about 10 carbon atoms. The aryl is optionally substituted with one or more $C_1$-$C_{20}$ alkyl, alkylene, alkoxy, or haloalkyl groups. Exemplary aryl groups include phenyl or naphthyl, or substituted phenyl or substituted naphthyl.

"Arylalkyl" refers to an aryl-alkylene-group, where aryl and alkylene are defined herein. Exemplary arylalkyl groups include benzyl, phenylethyl, phenylpropyl, 1-naphthylmethyl, and the like.

"Alkoxy" refers to an alkyl group as defined above with the indicated number of carbon atoms attached through an oxygen bridge. Exemplary alkoxy groups include methoxy, ethoxy, n-propoxy, i-propoxy, n-butoxy, s-butoxy, t-butoxy, n-pentoxy, and s-pentoxy.

"Halogen" refers to fluorine, chlorine, bromine, or iodine.

"Dicarboxylic acid compounds" includes organic aliphatic and aromatic (aryl) dicarboxylic acids and their corresponding acid chlorides, anhydrides and esters, and mixtures thereof. Exemplary dicarboxylic acid compounds include maleic acid, succinic acid, glutaric acid, adipic acid, pimelic acid, suberic acid, azelaic acid, sebacic acid, phthalic acid, isophthalic acid, terephthalic acid, naphthalenedicarboxylic acid, dimethyl maleate, dimethyl malonate, diethyl malonate, dimethyl succinate, di-isopropyl succinate, dimethyl glutarate, diethyl glutarate, dimethyl adipate, methyl ethyl adipate, dimethyl sebacate, dimethyl phthalate, dimethyl isophthalate, dimethyl terephthalate, dimethyl naphthalenedicarboxylate, dibasic esters (DBE), poly(ethylene glycol) bis(carboxymethyl)ether, succinyl chloride, glutaryl dichloride, adipoyl chloride, sebacoyl chloride, sebacate, phthaloyl chloride, isophthaloyl chloride, terephthaloyl chloride, naphthalenedicarboxylate, maleic anhydride, succinic anhydride, glutaric anhydride, phthalic anhydride, 1,8-naphthalic anhydride, and the like.

"Polyalkylene polyamines" can include polyamines such as polyethylene polyamine, polypropylene polyamine, and polyoxybutylene polyamine. In an embodiment, "polyalkylene polyamine" refers to those organic compounds having two primary amine (—$NH_2$) groups and at least one secondary amine group where the amino nitrogen atoms are linked together by alkylene groups, provided no two nitrogen atoms are attached to the same carbon atoms. Exemplary polyalkylene polyamines include diethylenetriamine (DETA), triethylenetetraamine (TETA), tetraethylenepentaamine (TEPA), dipropylenetriamine, and the like.

"Polyamidoamine" refers to a condensation product of one or more of the polycarboxylic acids and/or a polycarboxylic acid derivative with one or more of a polyalkylene polyamine.

"Paper strength" means a property of a paper material, and can be expressed, inter alia, in terms of dry strength and/or wet strength. Dry strength is the tensile strength exhibited by the dry paper sheet, typically conditioned under uniform humidity and room temperature conditions prior to testing. Wet strength is the tensile strength exhibited by a paper sheet that has been wetted with water prior to testing.

As used herein, the terms "paper" or "paper product" (these two terms are used interchangeably) is understood to include a sheet material that contains paper fibers, which may also contain other materials. Suitable paper fibers include natural and synthetic fibers, for example, cellulosic fibers, wood fibers of all varieties used in papermaking, other plant fibers, such as cotton fibers, fibers derived from recycled paper; and the synthetic fibers, such as rayon, nylon, fiberglass, or polyolefin fibers. The paper product may be composed only of synthetic fibers. Natural fibers may be mixed with synthetic fibers. For instance, in the preparation of the paper product the paper web or paper material may be reinforced with synthetic fibers, such as nylon or fiberglass, or impregnated with nonfibrous materials, such as plastics, polymers, resins, or lotions. As used herein, the terms "paper web" and "web" are understood to include both forming and formed paper sheet materials, papers, and paper materials containing paper fibers. The paper product may be a coated, laminated, or composite paper material. The paper product can be bleached or unbleached.

Paper can include, but is not limited to, writing papers and printing papers (e.g., uncoated mechanical, total coated paper, coated free sheet, coated mechanical, uncoated free sheet, and the like), industrial papers, tissue papers of all varieties, paperboards, cardboards, packaging papers (e.g., unbleached kraft paper, bleached kraft paper), wrapping papers, paper adhesive tapes, paper bags, paper cloths, toweling, wallpapers, carpet backings, paper filters, paper mats, decorative papers, disposable linens and garments, and the like.

Paper can include tissue paper products. Tissue paper products include sanitary tissues, household tissues, industrial tissues, facial tissues, cosmetic tissues, soft tissues, absorbent tissues, medicated tissues, toilet papers, paper towels, paper napkins, paper cloths, paper linens, and the like. Common paper products include printing grade (e.g., newsprint, catalog, rotogravure, publication, banknote, document, bible, bond, ledger, stationery), industrial grade (e.g., bag, linerboard, corrugating medium, construction paper, greaseproof, glassine), and tissue grade (e.g., sanitary, toweling, condenser, wrapping).

In an exemplary embodiment, tissue paper may be a feltpressed tissue paper, a pattern densified tissue paper, or a high bulk, uncompacted tissue paper. In an exemplary embodiment, the tissue paper may be creped or uncreped, of a homogeneous or multilayered construction, layered or non-layered (blended), and one-ply, two-ply, or three or more plies. In an exemplary embodiment, tissue paper includes soft and absorbent paper tissue products are consumer tissue products.

Paperboard is a paper that is thicker, heavier, and less flexible than conventional paper. Many hardwood and softwood tree species are used to produce paper pulp by mechanical and chemical processes that separate the fibers from the wood matrix. Paperboard can include, but is not limited to, semichemical paperboard, linerboards, containerboards, corrugated medium, folding boxboard, and cartonboards.

In an exemplary embodiment, paper refers to a paper product such as dry paper board, fine paper, towel, tissue, and newsprint products. Dry paper board applications include liner, corrugated medium, bleached, and unbleached dry paper board.

In an embodiment, paper can include carton board, container board, and special board/paper. Paper can include boxboard, folding boxboard, unbleached kraft board, recycled board, food packaging board, white lined chipboard, solid bleached board, solid unbleached board, liquid paper board, linerboard, corrugated board, core board, wallpaper base, plaster board, book bindery board, woodpulp board, sack board, coated board, and the like.

"Pulp" refers to a fibrous cellulosic material. Suitable fibers for the production of the pulps are all conventional grades, for example mechanical pulp, bleached and unbleached chemical pulp, recycled pulp, and paper stocks obtained from all annuals. Mechanical pulp includes, for example, groundwood, thermomechanical pulp (TMP), chemothermochemical pulp (CTMP), groundwood pulp produced by pressurized grinding, semi-chemical pulp, high-yield chemical pulp and refiner mechanical pulp (RMP). Examples of suitable chemical pulps are sulfate, sulfite, and soda pulps. The unbleached chemical pulps, which are also referred to as unbleached kraft pulp, can be particularly used.

"Pulp slurry" refers to a mixture of pulp and water. The pulp slurry is prepared in practice using water, which can be partially or completely recycled from the paper machine. It can be either treated or untreated white water or a mixture of such water qualities. The pulp slurry may contain interfering substances (e.g., fillers). The filler content of paper may be up to about 40% by weight. Suitable fillers are, for example, clay, kaolin, natural and precipitated chalk, titanium dioxide, talc, calcium sulfate, barium sulfate, alumina, satin white or mixtures of the stated fillers.

"Papermaking process" is a method of making paper products from pulp comprising, inter alia, forming an aqueous pulp slurry, draining the pulp slurry to form a sheet, and drying the sheet. The steps of forming the papermaking furnish, draining and drying may be carried out in any conventional manner generally known to those skilled in the art.

Discussion

In various exemplary embodiments described herein, a paper material may be formed by treating an aqueous pulp slurry with an aldehyde-functionalized polymer resin and a polyamidoamine epihalohydrin resin, where the ratio of the aldehyde-functionalized polymer resin to the polyamidoamine epihalohydrin resin is about 1:1 or more. In some embodiments, the polyamidoamine epihalohydrin resin has an azetidinium content of about 80% or less. In some embodiments, the polyamidoamine epihalohydrin resin has a total level of epichlorohydrin and its byproducts (AOX) of about 400 ppm or less. In some embodiments, the polyamidoamine epihalohydrin resin has an azetidinium content of about 80% or less and the polyamidoamine epihalohydrin resin has a total level of epichlorohydrin and byproducts (AOX) of about 400 ppm or less.

As mentioned above, commercially available epichlorohydrin-based wet strength resins are prepared by the reaction of epichlorohydrin in aqueous solution with polymers containing secondary amino groups and include high levels of epichlorohydrin and its byproducts (e.g., 1000 ppm or more). Since the epichlorohydrin and its byproducts are considered to be environmental pollutants, alternatives to commercially available epichlorohydrin-based wet strength resins are needed.

In the exemplary embodiments described herein, by carefully controlling the epi/amine ratio of the polyamidoamine epihalohydrin resin, and/or the azetidinium content of the polyamidoamine epihalohydrin resin, a polyamidoamine epihalohydrin resin can be produced having very low amounts of epihalohydrin and other haloorganic byproducts. These types of polyamidoamine epihalohydrin resins can be used in a creping step for making paper as a crepe adhesive. However, the crepe adhesive is used as an adhesive between a paper web and a cylinder and does not include the aldehyde-functionalized polymer resin. Thus, the crepe adhesive is used in a completely separate and distinct stage of the paper making process and for a completely different purpose as exemplary embodiments of the present disclosure.

In an exemplary embodiment, paper can be formed by the treatment of an aqueous pulp slurry with an aldehyde-functionalized polymer resin and a polyamidoamine epihalohydrin resin (e.g., polyamidoamine epichlorohydrin (PAE) resin).

In an exemplary embodiment, the aldehyde-functionalized polymer resin can be produced by reacting a polymer including one or more hydroxyl, amine, or amide groups with one or more aldehydes. In an exemplary embodiment, the polymeric aldehyde-functionalized polymer resin can comprise gloxylated polyacrylamides, aldehyde-rich cellulose, aldehyde-functional polysaccharides, or aldehyde functional cationic, anionic or non-ionic starches. Exemplary materials include those disclosed in U.S. Pat. No. 4,129,722, which is herein incorporated by reference. An example of a commercially available soluble cationic aldehyde functional starch is Cobond® 1000 marketed by National Starch. Additional exemplary aldehyde-functionalized polymers may include aldehyde polymers such as those disclosed in U.S. Pat. No. 5,085,736; U.S. Pat. No. 6,274,667; and U.S. Pat. No. 6,224,714; all of which are herein incorporated by reference, as well as the those of WO 00/43428 and the aldehyde functional cellulose described in WO 00/50462 A1 and WO 01/34903 A1. In an exemplary embodiment, the polymeric aldehyde-functional resins can have a molecular weight of about 10,000 Da or greater, about 100,000 Da or greater, or about 500,000 Da or greater. Alternatively, the polymeric aldehyde-functionalized resins can have a molecular weight below about 200,000 Da, such as below about 60,000 Da.

In an exemplary embodiment, further examples of aldehyde-functionalized polymers can include dialdehyde guar, aldehyde-functional wet strength additives further comprising carboxylic groups as disclosed in WO 01/83887, dialdehyde inulin, and the dialdehyde-modified anionic and amphoteric polyacrylamides of WO 00/11046, each of which are herein incorporated by reference. Another exemplary aldehyde-functionalized polymer is an aldehyde-containing surfactant such as those disclosed in U.S. Pat. No. 6,306,249, which is incorporated herein by reference.

When used in an exemplary embodiment, the aldehyde-functionalized polymer can have at least about 5 milliequivalents (meq) of aldehyde per 100 grams of polymer, more specifically at least about 10 meq, more specifically about 20 meq or greater, or most specifically about 25 meq, per 100 grams of polymer or greater.

In an exemplary embodiment, the polymeric aldehyde-functionalized polymer can be a glyoxylated polyacrylamide, such as a cationic glyoxylated polyacrylamide as described in U.S. Pat. No. 3,556,932, U.S. Pat. No. 3,556,933, U.S. Pat. No. 4,605,702, U.S. Pat. No. 7,828,934, and U.S. Patent Application 20080308242, each of which is incorporated herein by reference. Such compounds include FENNOBOND™ 3000 and PAREZ™ 745 from Kemira Chemicals of Helsinki, Finland, HERCOBOND™ 1366, manufactured by Hercules, Inc. of Wilmington, Del.

In an exemplary embodiment, the aldehyde functionalized polymer is a glyoxalated polyacrylamide resin having the ratio of the number of substituted glyoxal groups to the number of glyoxal-reactive amide groups being in excess of about 0.03:1, being in excess of about 0.10:1, or being in excess of about 0.15:1.

In an exemplary embodiment, the aldehyde functionalized polymer can be a glyoxalated polyacrylamide resin having a polyacrylamide backbone with a molar ratio of acrylamide to dimethyldiallylammonium chloride of about 99:1 to 50:50, about 98:1 to 60:40, or about 96:1 to 75:25. In an exemplary embodiment, the weight average molecular weight of the polyacrylamide backbone can be about 250,000 Da or less, about 150,000 Da or less, or about 100,000 Da or less. The Brookfield viscosity of the polyacrylamide backbone can be about 10 to 10,000 cps, about 25 to 5000 cps, about 50 to 2000 cps, for a 40% by weight aqueous solution.

In an exemplary embodiment, the polyamidoamine epihalohydrin resin can be prepared by reacting one or more polyalkylene polyamines and one or more a polycarboxylic acid and/or a polycarboxylic acid derivative compounds to form a polyamidoamine and then reacting the polyamidoamine with epihalohydrin to form the polyamidoamine epihalohydrin resin. The reactants may be heated to an elevated temperature, for example about 125 to 200° C. The reactants may be allowed to react for a predetermined time, for example about 1 to 10 hours. During the reaction, condensation water may be collected. The reaction may be allowed to proceed until the theoretical amount of water distillate is collected from the reaction. In an exemplary embodiment, the reaction may be conducted at atmospheric pressure.

In various embodiments, the polyamidoamine epihalohydrin resin and the preparation of the polyamidoamine epihalohydrin resin may be as described in one or more of U.S. Pat. Nos. 2,926,116, 2,926,154, 3,197,427, 3,442,754, 3,311,594, 5,171,795, 5,614,597, 5,017,642, 5,019,606, 7,081,512, 7,175,740, 5,256,727, 5,510,004, 5,516,885, 6,554,961, 5,972,691, 6,342,580, and 7,932,349, and U.S. Published Patent Application 2008/0255320, each of which is incorporated herein by reference, where the polyamidoamine epihalohydrin resin functions and has the characteristics (e.g., total AOX level, azetidinium content, etc.) described herein, and the mixture produced using the polyamidoamine epihalohydrin resin functions and has the characteristics described herein.

In an exemplary embodiment, the polyamine can include an ammonium, an aliphatic amine, an aromatic amine, or a polyalkylene polyamine. In an exemplary embodiment, the polyalkylene polyamine can include a polyethylene polyamine, a polypropylene polyamine, a polybutylene polyamine, a polypentylene polyamine, a polyhexylene polyamine, or a mixture thereof. In an exemplary embodiment, the polyamine can include ethylene diamine (EDA), diethylenetriamine (DETA), triethylenetetramine (TETA), tetraethylenepentamine (TEPA), dipropylenetriamine (DPTA), bis-hexamethylenetriamine (BHMT), N-methylbis (aminopropyl)amine (MBAPA), aminoethyl-piperazine (AEP), pentaetehylenehexamine (PEHA), or a mixture thereof.

In alternative embodiments, the reaction may proceed under a reduced pressure. Where a reduced pressure is employed, a lower temperature of about 75° C. to 180° C. may be utilized. At the end of this reaction, the resulting product may be dissolved in water at a concentration of about 20 to 90% by weight total polymer solids, or about 30 to 80% by weight total polymer solids, or about 40 to 70% by weight total polymer solids. In the preparation of the polyamidoamines, the molar ratio of the polyamine to the polycarboxylic acid and/or polycarboxylic acid derivative can be about 1.05 to 2.0.

In an exemplary embodiment, the polycarboxylic acid and/or polycarboxylic acid derivatives thereof (e.g., an ester of the polycarboxylic acid, an acid halide of the polycarboxylic acid, an acid anhydride of the polycarboxylic acid, and the like) can include malonic acid, glutaric acid, adipic acid, azelaic acid, citric acid, tricarballylic acid (1,2,3-propanetricarboxylic acid), 1,2,3,4-butanetetracarboxylic acid, nitrilotriacetic acid, N,N,N',N'-ethylenediaminetetraacetate, 1,2-cyclohexanedicarboxylic acid, 1,3-cyclohexanedicarboxylic acid, 1,4-cyclohexanedicarboxylic acid, phthalic acid, isophthalic acid, terephthalic acid, 1,2,4-benzenetricarboxylic acid (trimellitic acid), 1,2,4,5-benzenetetracarboxylic acid (pyromellitic acid), a carboxylate ester of any of these, an acid halide of any of these, an acid anhydride of any of these, or a mixture thereof.

In an exemplary embodiment, an ester of polycarboxylic acids can include dimethyl adipate, dimethyl malonate, diethyl malonate, dimethyl succinate, dimethyl glutarate and diethyl glutarate. In an exemplary embodiment, the acid anhydride can include succinic anhydride, maleic anhydride, N,N,N',N'-ethylenediaminetetraacetate dianhydride, phthalic anhydride, mellitic anhydride, pyromellitic anhydride, or a mixture thereof. In an exemplary embodiment, the acid halide can include adipoyl chloride, glutaryl chloride, sebacoyl chloride, or a mixture thereof.

In an exemplary embodiment, the polyamidoamine can have a molar ratio of polyalkylene polyamine to dicarboxylic acid of about 2:1 to 0.5:1, about 1.8:1 to 0.75:1, or about 1.6:1 to 0.85:1.

In an exemplary embodiment, the polyamidoamine resin can have a reduced specific viscosity of about 0.02 dL/g to 0.25 dL/g, about 0.04 dL/g to 0.20 dL/g, or about 0.06 dL/g to 0.18 dL/g. Reduced specific viscosity (RSV) can be measured using a glass capillary viscometer at 30° C. The efflux time of each sample can be determined three times and the average efflux time calculated. The RSV can be calculated using the following formula (1):

$$\mathrm{RSV}=((t-t_0))/(t_0c) \tag{1}$$

where t is the average efflux time of the polyamidoamine sample diluted with 1 M NaCl solution, $t_0$ is the average efflux time of 1 M NaCl solution, c is the concentration of the diluted polyamidoamine sample, which is 5 g/dL.

In an exemplary embodiment, the epihalohydrin can be a difunctional crosslinker that is used to prepare the polyamidoamine epihalohydrin resin. In an exemplary embodiment, the epihalohydrin can include epichlorohydrin, epifluorohydrin, epibromohydrin, or epiiodohydrin, alkyl-substituted epihalohydrins, or a mixture thereof. In an exemplary embodiment, the difunctional crosslinker for preparing the polyamindoamine epihalohydrin resin is epichlorohydrin.

In an exemplary embodiment, the ratio of aldehyde-functionalized polymer resin to polyamidoamine epihalohydrin resin can be about 1:1 or more or about 1:1 to 100:1.

In an exemplary embodiment, the polyamidoamine epihalohydrin resin has an epihalohydrin/amine (also expressed herein as "epi/amine" or "E/N") ratio of about 0.8 or less, about 0.5 or less, about 0.45 or less, about 0.4 or less, or about 0.3 or less. In an embodiment, the polyamidoamine epihalohydrin resin has an E/N ratio of about 0.01 to 0.8, about 0.01 to 0.5, about 0.01 to 0.45, about 0.01 to 0.4, or about 0.01 to 0.3. The epi/amine ratio is calculated as the molar ratio of epichlorohydrin to amine content.

As mentioned above, polyamidoamine epihalohydrin resin can be prepared by reacting epichlorohydrin with polyamidoamine. During the first step of the polyamidoamine epihalohydrin resin synthesis, epichlorohydrin reacts with polyamidoamine and forms amino-chlorohydrin. During the second step of the reaction, amino-chlorohydrin is converted azetidinium. In an exemplary embodiment, the azetidinium content can be controlled by selection of the polyamidoamine backbone, the percent solids content of the resin, ratio of the components to form the polyamidoamine epihalohydrin resin, the epihalohydrin/amine ratio, the time frame, temperature, and/or the pH of the reaction and/or addition of components, and the like. One or more of these variables can be used to produce a polyamidoamine epihalohydrin resin having an azetidinium content as described herein.

In an embodiment, the polyamidoamine epihalohydrin resin can have an azetidinium content of about 80% or less, of about 70% or less, of about 60% or less, of about 50% or less, or of about 40% or less. In an embodiment, the polyamidoamine epihalohydrin resin can have an azetidinium content of about 0.01 to 80%, about 0.01 to 70%, about 0.01 to 60%, about 0.01 to 50%, or about 0.01 to 40%.

The azetidinium content can be calculated in a manner as described below. The inverse gated $^{13}C$ NMR spectra are acquired using the Bruker-Oxford Avance II 400 MHz NMR spectrometer with a 10 mm PABBO BB probe. The NMR solutions were prepared as is; no NMR solvent was added. The number of scans was chosen to be 1000 and acquisition temperature was 30° C. The peak assignments of PAE resins were based on literature reports (for example, Takao Obokata and Akira Isogai, 1H- and 13C-NMR analyses of aqueous polyamideamine-epichlorohydrin resin solutions, Journal of Applied Polymer Science, 92(3), 1847, 2004, which is incorporated herein by reference).

As an example, the azetidinium content of Example 1 is calculated herein. The 13C NMR chemical shifts of PAE resin Example 1 were assigned and labeled in FIG. 1. The azetidinium content, $r_a$, refers to the mole ratio of azetidinium groups relative to the secondary amine groups on the base polymer.

$$r_a = \frac{2 \cdot A_f}{A_c + A_{c'}} \tag{1}$$

where $A_f$ is the integration of chemical shift f, $A_c$ is the integration of chemical shift c, and $A_{c'}$ is the chemical shift of c'. Since c and c' are overlapping with b, $A_c+A_{c'}$ is calculated indirectly as $$A_c+A_{c'}=\text{integration}(33-43\ \text{ppm})-\text{integration}(23-29\ \text{ppm}) \tag{2}$$

The aminochlorohydrin content, $r_b$, refers to the mole ratio of aminochlorohydrin groups relative to the secondary amine groups on the basepolymer, $$r_b = \frac{A_{d'}}{A_c + A_{c'}} \tag{3}$$

where $A_{d'}$ is the integration of the chemical shift d'.

Since all or a substantial portion of the epichlorohydrin is reacted with the amine groups to functionalize the polymer, the amount of epichlorohydrin that remains in the aqueous solution to react with water or chlorine to form byproducts is eliminated or substantially reduced as compared to when other commercially available components are used.

In an embodiment, the mixture can have a total level of epichlorohydrin and its byproducts (also noted as total absorbable organic halides (AOX) level) that can be about 400 ppm or less, about 300 ppm or less, about 200 ppm or less, about 100 ppm or less, about 50 ppm or less, or about 10 ppm or less, where the AOX level is based on 12.5% actives based total polymer solids. The AOX can include one or more of epihalohydrin, 1,3-dihalo-2-propanol, 3-monohalo-1,2-propanediol, and 2,3-dihalo-1-propanol. When the polyamidoamine epihalohydrin resin includes epichlorohydrin, the AOX can include one or more of epichlorohydrin, 1,3-dichloro-2-propanol, 3-monochloro-1,2-propanediol, and 2,3-dichloro-1-propanol. These compounds are known to be toxic to humans, so reduction or elimination of these components from paper is advantageous.

The phrase "% actives based" in regard to the mixture has a total level of epichlorohydrin and its byproducts means the total weight percentage of the epichlorohydrin and its byproducts in a product containing the specified percent weight of polymer actives. The % actives are measured as polymer solids by moisture balance.

Surprisingly, it has been found that these polyamidoamine epihalohydrin resins can be used in combination with the aldehyde-functionalized polymer resin as a wet strength agent in certain conditions to provide improved dry and temporary wet strength performance, and drainage characteristics, while also having low azetidinium content and a low total level of epihalohydrin and byproducts (AOX) relative to those that use commercial components.

In some embodiments, the aldehyde functional polymer resin and polyamidoamine epihalohydrin resin may be provided separately (e.g., either simultaneously, or sequentially) to the pulp slurry. Subsequently, the pulp slurry can be made into a fibrous substrate and then into a paper product. In some embodiments, the aldehyde-functional polymer resin and polyamidoamine epihalohydrin resin may be provided as a mixture and the mixture is introduced to the pulp slurry. In some embodiments, a mixture of aldehyde-functionalized polymer resin and a polyamidoamine epihalohydrin resin can be prepared, as described in more detail below.

In an exemplary embodiment, the aldehyde-functional polymer resin and polyamidoamine epihalohydrin (PAE) resin system (herein after "resin system") or a component thereof can be applied as an aqueous solution(s) to a cellulosic web, fibrous slurry, or individual fibers. In addition to being applied as an aqueous solution, the resin system or a component thereof can also be applied in the form of a suspension, a slurry, or as a dry reagent depending upon the particular application. In one exemplary embodiment, PAE and an aldehyde-functionalized polymer may be provided as a dry reagent, with sufficient water to permit interaction of the PAE polymer with the molecules of the aldehyde functionalized polymer.

In an exemplary embodiment, the individual components of the resin system may be combined first and then applied to a web or fibers, or the two components, may be applied sequentially in either order. After the two components have been applied to the web, the web or fibers are dried and heatedly sufficiently to achieve the desired interaction between the two compounds.

By way of example only, application of the resin system or components thereof can be applied by any of the following methods or combinations thereof.

In an exemplary embodiment, the method can include direct addition of the resin system or components thereof to a fibrous slurry, such as by injection of the compound into a slurry prior to entry in the headbox. In an exemplary embodiment, the slurry can be about 0.1% to about 50%, about 0.2% to 10%, about 0.3% to about 5%, or about 0.4% to about 4%.

In an exemplary embodiment, the method can include spraying the resin system or components thereof to a fibrous web. For example, spray nozzles may be mounted over a moving paper web to apply a desired dose of a solution to a web that can be moist or substantially dry.

In an exemplary embodiment, the method can include application of the resin system or components thereof by spray or other means to a moving belt or fabric, which in turn contacts the tissue web to apply the chemical to the web, such as is disclosed in WO 01/49937.

In an exemplary embodiment, the method can include printing the resin system or components thereof onto a web, such as by offset printing, gravure printing, flexographic printing, ink jet printing, digital printing of any kind, and the like.

In an exemplary embodiment, the method can include coating the resin system or components thereof onto one or both surfaces of a web, such as blade coating, air knife coating, short dwell coating, cast coating, and the like.

In an exemplary embodiment, the method can include extrusion from a die head of the resin system or components thereof in the form of a solution, a dispersion or emulsion, or a viscous mixture.

In an exemplary embodiment, the method can include application of resin system or components thereof to individualized fibers. For example, comminuted or flash dried fibers may be entrained in an air stream combined with an aerosol or spray of the compound to treat individual fibers prior to incorporation into a web or other fibrous product.

In an exemplary embodiment, the method can include impregnation of a wet or dry web with a solution or slurry of the resin system or components thereof, where the resin system or components thereof penetrates a significant distance into the thickness of the web, such as about 20% or more of the thickness of the web, about 30% or more of the thickness of the web, and about 70% or more of the thickness of the web, including completely penetrating the web throughout the full extent of its thickness.

In an embodiment, the method for impregnation of a moist web can include the use of the Hydra-Sizer® system, produced by Black Clawson Corp., Watertown, N.Y., as described in "New Technology to Apply Starch and Other Additives," Pulp and Paper Canada, 100(2): T42-T44 (February 1999). This system includes a die, an adjustable support structure, a catch pan, and an additive supply system. A thin curtain of descending liquid or slurry is created which contacts the moving web beneath it. Wide ranges of applied doses of the coating material are said to be achievable with good runnability. The system can also be applied to curtain coat a relatively dry web, such as a web just before or after creping.

In an exemplary embodiment, the method can include a foam application of the resin system or components thereof to a fibrous web (e.g., foam finishing), either for topical application or for impregnation of the additive into the web under the influence of a pressure differential (e.g., vacuum-assisted impregnation of the foam). Principles of foam application of additives such as binder agents are described in the following publications: F. Clifford, "Foam Finishing Technology: The Controlled Application of Chemicals to a Moving Substrate," *Textile Chemist and Colorist*, Vol. 10, No. 12, 1978, pages 37-40; C. W. Aurich, "Uniqueness in Foam Application," Proc. 1992 *Tappi Nonwovens Conference*, Tappi Press, Atlanta, Ga., 1992, pp. 15-19; W. Hartmann, "Application Techniques for Foam Dyeing & Finishing", *Canadian Textile Journal*, April 1980, p. 55; U.S. Pat. No. 4,297,860, and U.S. Pat. No. 4,773,110, each of which is herein incorporated by reference.

In an exemplary embodiment, the method can include padding of a solution containing the resin system or components thereof into an existing fibrous web.

In an exemplary embodiment, the method can include roller fluid feeding of a solution of resin system or components thereof for application to the web.

When applied to the surface of a paper web, an exemplary embodiment of the present disclosure may include the topical application of the resin system (e.g., the PAE polymer and, optionally the aldehyde-functionalized polymer resin) can occur on an embryonic web prior to Yankee drying or through drying, and optionally after final vacuum dewatering has been applied.

In an exemplary embodiment, the application level of the resin system or components thereof can be about 0.05% to about 10% by weight relative to the dry mass of the web for any of the paper strength system. In exemplary embodiment, the application level can be about 0.05% to about 4%, or about 0.1% to about 2%. Higher and lower application levels are also within the scope of the embodiments. In some embodiments, for example, application levels of from about 5% to about 50% or higher can be considered.

In an exemplary embodiment, the resin system or components thereof when combined with the web or with cellulosic fibers (e.g., pulp slurry) can have any pH, though in many embodiments it is desired that the resin system or components thereof is in solution in contact with the web or with fibers have a pH below about 10, about 9, about 8 or about 7, such as about 2 to about 8, about 2 to about 7, about 3 to about 6, and about 3 to about 5.5. Alternatively, the pH range may be about 5 to about 9, about 5.5 to about 8.5, or about 6 to about 8. These pH values can apply to the PAE polymer prior to contacting the web or fibers, or to a mixture of the resin system or components thereof in contact with the web or the fibers prior to drying.

In an embodiment, the temperature of the pulp slurry can be about 10 to 80° C. when the mixture is added to the pulp slurry. In an embodiment, the process variables may be modified as necessary or desired, including, for example, the temperature of pre-mixing the components, the time of pre-mixing the components, and the concentration of the pulp slurry.

Ignoring the presence of chemical compounds other than the resin system or components thereof and focusing on the distribution of the resin system or components thereof in the web, one skilled in the art will recognize that the resin system or components thereof can be distributed in a wide variety of ways. For example, the resin system or components thereof may be uniformly distributed, or present in a pattern in the web, or selectively present on one surface or in one layer of a multilayered web. In multi-layered webs, the entire thickness of the paper web may be subjected to application of the resin system or components thereof and other chemical treatments described herein, or each individual layer may be independently treated or untreated with the resin system or components thereof and other chemical treatments of the present disclosure. In an exemplary embodiment, the resin system or components thereof is predominantly applied to one layer in a multilayer web. Alternatively, at least one layer is treated with significantly less resin system or components thereof than other layers. For example, an inner layer can serve as a treated layer with increased wet strength or other properties.

In an exemplary embodiment, the resin system or components thereof may also be selectively associated with one of a plurality of fiber types, and may be adsorbed or chemisorbed onto the surface of one or more fiber types. For example, bleached kraft fibers can have a higher affinity for the resin system or components thereof than synthetic fibers that may be present.

In an exemplary embodiment, certain chemical distributions may occur in webs that are pattern densified, such as the webs disclosed in any of the following U.S. Pat. No. 4,514,345; U.S. Pat. No. 4,528,239; U.S. Pat. No. 5,098,522; U.S. Pat. No. 5,260,171; U.S. Pat. No. 5,275,700; U.S. Pat. No. 5,328,565; U.S. Pat. No. 5,334,289; U.S. Pat. No. 5,431,786; U.S. Pat. No. 5,496,624; U.S. Pat. No. 5,500,277; U.S. Pat. No. 5,514,523; U.S. Pat. No. 5,554,467; U.S. Pat. No. 5,566,724; U.S. Pat. No. 5,624,790; and U.S. Pat. No. 5,628,876, the disclosures of which are incorporated herein by reference to the extent that they are non-contradictory herewith.

In an exemplary embodiment, the resin system or components thereof, or other chemicals can be selectively concentrated in the densified regions of the web (e.g., a densified network corresponding to regions of the web compressed by an imprinting fabric pressing the web against a Yankee dryer, where the densified network can provide good tensile strength to the three-dimensional web). This is particularly so when the densified regions have been imprinted against a hot dryer surface while the web is still wet enough to permit migration of liquid between the fibers to occur by means of capillary forces when a portion of the web is dried. In this case, migration of the aqueous solution resin system or components thereof can move the resin system or components thereof toward the densified regions experiencing the most rapid drying or highest levels of heat transfer.

The principle of chemical migration at a microscopic level during drying is well attested in the literature. See, for example, A. C. Dreshfield, "The Drying of Paper," *Tappi Journal*, Vol. 39, No. 7, 1956, pages 449-455; A. A. Robertson, "The Physical Properties of Wet Webs. Part 1," *Tappi Journal*, Vol. 42, No. 12, 1959, pages 969-978; U.S. Pat. No. 5,336,373, and U.S. Pat. No. 6,210,528, each of which is herein incorporated by reference.

Without wishing to be bound by theory, it is believed that chemical migration may occur during drying when the initial solids content (dryness level) of the web is below about 60% (e.g., less than any of about 65%, about 63%, about 60%, about 55%, about 50%, about 45%, about 40%, about 35%, about 30%, and about 27%, such as about 30% to 60%, or about 40% to about 60%). The degree of chemical migration can depend, for example, on the surface chemistry of the fibers, the chemicals involved, the details of drying, the structure of the web, and so forth. On the other hand, if the web with a solid contents below about 60% is through-dried to a high dryness level, such as at least any of about 60% solids, about 70% solids, and about 80% solids (e.g., from 65% solids to 99% solids, or from 70% solids to 87% solids), then regions of the web disposed above the deflection conduits (i.e., the bulky "domes" of the pattern-densified web) may have a higher concentration of resin system or components thereof, or other water-soluble chemicals than the densified regions, for drying will tend to occur first in the regions of the web through which air can readily pass, and capillary wicking can bring fluid from adjacent portions of the web to the regions where drying is occurring most rapidly. In short, depending on how drying is carried out, water-soluble reagents may be present at a relatively higher concentration (compared to other portions of the web) in the densified regions or the less densified regions ("domes").

The resin system or components thereof may also be present substantially uniformly in the web, or at least without a selective concentration in either the densified or undensified regions.

According to an exemplary method, the conditions (e.g., temperature of the pulp slurry, temperature of pre-mixing the components, time of pre-mixing the components, concentration of the resin system or components thereof, co-mixing of solids, and the like) of the pulp slurry and process can vary, as necessary or desired, depending on the particular paper product to be formed, characteristics of the paper product formed, and the like. In an embodiment, the temperature of the pulp slurry can be about 10 to 80° C. when the resin system or components thereof is added to the pulp slurry. In an embodiment, the process variables may be modified as necessary or desired, including, for example, the temperature of pre-mixing the components, the time of pre-mixing the components, and the concentration of the pulp slurry.

In various exemplary embodiments a paper may be formed by the treatment of a cellulosic fiber or an aqueous pulp slurry with a resin system or components thereof as described herein. The paper can be formed using one or more methods, including those described herein.

In various exemplary embodiments a paper may be formed by the treatment of an aqueous pulp slurry with an aldehyde-functionalized polymer resin and a polyamidoamine epihalohydrin resin. The aldehyde-functionalized polymer resin to polyamidoamine epihalohydrin resin ratio, the azetidinium content, and/or the total AOX level can be the same as those described above. The paper can be formed using one or more methods, including those described herein.

In an exemplary embodiment, the resultant paper has improved dry and temporary wet strength performance, and drainage characteristics relative to paper produced using commercially available GPAM and PAE, where the polyamidoamine epihalohydrin resin used has an azetidinium content of about 80% or less and/or the polyamidoamine epihalohydrin resin has a total level of epichlorohydrin and byproducts (AOX) level of about 400 ppm or less.

Tensile strength (wet or dry) can be measured by applying a constant rate-of-elongation to a sample and recording tensile properties of the sample, including, for example: the force per unit width required to break a sample (tensile strength), the percentage elongation at break (stretch), and the energy absorbed per unit area of the sample before breaking (tensile energy absorption). This method is applicable to all types of paper, but not to corrugated board. These measurements reference TAPPI Test Method T494 (2001), as modified as described herein.

Wet tensile strength is determined after paper and paperboard contacting with water for a given wetting time. The 1" wide paper strip is placed in the tensile testing machine and wetted for both strip sides with distilled water by a paint brush. After the contact time of 2 seconds, the strip is broken as required in 6.8-6.10 of T 494 to generate initial wet tensile strength. The initial wet tensile strength is useful in the evaluation of the performance characteristics of tissue products, paper towels and other papers subjected to stress during processing or use while instantly wet. This method references U.S. Pat. No. 4,233,411, which is incorporated herein by reference.

Test Methods:

Dry Tensile Test

Tensile strength is measured by applying a constant-rate-of-elongation to a sample and recording three tensile breaking properties of paper and paper board: the force per unit width required to break a specimen (tensile strength), the percentage elongation at break (stretch) and the energy absorbed per unit area of the specimen before breaking (tensile energy absorption). This method is applicable to all types of paper, but not to corrugated board. This procedure references TAPPI Test Method T494 (2001), which is incorporated herein by reference, and modified as described.

Initial Wet Tensile Test

This test method is used to determine the initial wet tensile strength of paper and paperboard after contacting with water for 2 seconds. The 1" wide paper strip is placed in the tensile testing machine and wetted for both strip sides with distilled water by a paint brush. After the contact time of 2 seconds, the strip is broken as required in 6.8-6.10 of TAPPI Test Method 494(2001). The initial wet tensile is useful in the evaluation of the performance characteristics of tissue products, paper towels and other papers subjected to stress during processing or use while instantly wet. This method references TAPPI Test Method T456 (2005), which is incorporated herein by reference, and modified as described.

EXAMPLES

Now having described the embodiments, in general, the examples describe some additional embodiments. While embodiments are described in connection with the examples and the corresponding text and FIGURES, there is no intent to limit embodiments of the disclosure to these descriptions. On the contrary, the intent is to cover all alternatives, modifications, and equivalents included within the spirit and scope of exemplary embodiments.

Example 1: PAE Booster Resin with Intermediate Amine Content

In this Example, the PAE resin had a backbone of about 60% polyamidoamine and about 40% water and was prepared by a condensation reaction of diethylenetriamine and adipic acid (about a 1:1 molar ratio). The E/N mole ratio: 25/100. The % solids starting in the reaction of epichlorohydrin with the backbone was about 20 wt %. The final composition was about 15% polyamidoamine-epichlorohydrin and about 85% water. The pH of the PAE resin was about 3.8-4.2 and had a viscosity of about 40-70 cPs.

Example 2: PAE Booster Resin with High Amine Content

In this Example, the PAE resin had a backbone of about 60% polyamidoamine and about 40% water and was prepared by a condensation reaction of diethylenetriamine and adipic acid (about a 1:1 molar ratio). The E/N mole ratio: 8/100. The % solids starting in the reaction of epichlorohydrin with the backbone was about 32.5 wt %. The final composition was about 25% polyamidoamine-epichlorohydrin and about 75% water. The pH of the PAE resin was about 8.5-9.5 and has a viscosity of about 30-60 cPs.

Example 3: PAE Booster Resin with High Amine Content

In this Example, the PAE resin had a backbone of about 60% polyamidoamine and about 40% water and was prepared by a condensation reaction of diethylenetriamine and adipic acid (about a 1:1 molar ratio). The E/N mole ratio: 12/100. The % solids starting in the reaction of epichlorohydrin with the backbone was about 33.06 wt %. The final composition was about 15% polyamidoamine-epichlorohydrin and about 85% water. The pH of the PAE resin was about 5.8-6.2 and had a viscosity of about 70-120 cPs.

Example 4: PAE Booster with Low Amine Content

In this Example, the PAE resin had a backbone of about 60% polyamidoamine and about 40% water and was prepared by a condensation reaction of diethylenetriamine and adipic acid (about a 1:1 molar ratio). The E/N mole ratio: 35/100. The % solids starting in the reaction of epichlorohydrin with the backbone was about 15 wt %.

Example 5: PAE Booster with Low Amine Content

In this Example, the PAE resin had a backbone of about 60% polyamidoamine and about 40% water and was prepared by a condensation reaction of diethylenetriamine and adipic acid (about a 1:1 molar ratio). The E/N mole ratio: 42/100. The % solids starting in the reaction of epichlorohydrin with the backbone was about 15 wt %.

Example 6: PAE Booster with Low Amine Content

In this Example, the PAE resin had a backbone of about 60% polyamidoamine and about 40% water and was prepared by a condensation reaction of diethylenetriamine and adipic acid (about a 1:1 molar ratio). The E/N mole ratio: 50/100. The % solids starting in the reaction of epichlorohydrin with the backbone was about 15 wt %.

Table 1-1, below, shows the characteristics of the strength agents used in the examples, including % azetidinium, and residual by-products, both for Examples 1-4 and in comparison to some commercially available strength aids.

TABLE 1

PAE Resins vs. Industrial Strength Controls

| Sample | Description | % Actives | E/N | % Azet | % Amino-chlorohydrin | % solids | AOX |
|---|---|---|---|---|---|---|---|
| A | Glyoxalated polyacrylamide (GPAM) | | n/a | n/a | n/a | 8.1 | 0 |
| B | Permanent wet strength PAE resin | 30 | 1.25 | 58 | 41 | 30.0 | >1000 |
| C | Permanent wet strength PAE resin | 25 | | 88 | 25 | | >1000 |
| Example 1 | PAE booster with intermediate amine content | 25 | 0.25 | 6 | 16 | 25 | 12 |
| Example 2 | PAE booster with high amine content | 15 | 0.08 | 0 | 7 | 15 | 5 |
| Example 3 | PAE booster with high amine content | | 0.12 | 0 | 7 | 15 | 5 |
| Example 4 | PAE booster with low amine content | | 0.35 | 14 | 17 | 15 | 33 |
| Example 5 | PAE booster with low amine content | | 0.42 | 18 | 20 | 15 | 40 |
| Example 6 | PAE booster with low amine content | | 0.50 | 25 | 20 | 15 | 73 |

AOX refers to residual epichlorohydrin and also epichlorohydrin hydrolysis byproducts, including 1,3-dichloropropanol (1,3-DCP), 2,3-dichloropropanol (2,3-DCP), and 3-chloropropanediol (3-CPD).

Example 7: Handsheet Comparison—Acidic Conditions

In this example, various wet strength agents, as described above, were applied to handsheets under acidic papermaking conditions, and wet and dry tensile properties of the resultant handsheets were evaluated.

In this example, handsheets were prepared using a furnish of a 50/50 mixture of bleached hardwood and softwood kraft pulp refined to a Canadian Standard Freeness of 450 to which the stock pH was adjusted to a pH of 5.5. Deionized water was used for furnish preparation, and additional 150 ppm of sodium sulfate and 35 ppm of calcium chloride were added. While mixing, a batch of 0.6% solids containing 8.7 g of cellulose fibers was treated with various strength aid samples (described below) that were diluted to 1% wt. % with deionized water. After strength aid addition, the mixing/contact time was constant at 30 second. Then, three 2.9-g sheets of paper were formed using a standard (8"×8") Nobel & Woods handsheet mold, to target a basis weight of 50 lbs./3000 $ft^2$, pressed between felts in the nip of a pneumatic roll press at about 15 prig and dried on the rotary dryer at 230° F. The paper samples were oven cured for 10 minutes at the temperature of 110° C., then conditioned in the standard TAPPI control room for overnight.

In this example, the strength aid treatments included a combination of glyoxalated polyacrylamide (GPAM) dry strength resin (Baystrength® 3000, 7.5% solids, available from Kemira Chemicals) dry strength resin, and a PAE booster of Examples 1-6 above. As identified in Table 2 below, some samples were pre-mixed, and in others, the GPAM and PAE were added sequentially. For the premixed combinations, the GPAM was mixed with non-diluted boosters in the amounts identified in Table 2 below, for 10 minutes at the room temperature. Each treatment sample was diluted to a 1% solution. The handsheets were prepared with addition of the 1% solution.

TABLE 2

Handsheet Performance - GPAM with PAE Boosters - Acidic Papermaking pH 5.5

| PAE Booster | Booster Added Rate, lb./ton | GPAM Added Rate, lb./ton | Addition Mode | Dry Tensile lbs./in | Tensile Energy Absorbed lb. in/in$^2$ | Initial Wet Tensile lbs./in |
|---|---|---|---|---|---|---|
| Example 1 | 1.6 | 6.4 | Sequential | 19.39 | 0.82 | 4.09 |
| Example 2 | 1.6 | 6.4 | Sequential | 17.70 | 0.63 | 3.79 |
| Example 3 | 1.6 | 6.4 | Sequential | 18.62 | 0.80 | 3.9 |
| Example 1 | 1.6 | 6.4 | Pre-mixed | 24.14 | 1.04 | 4.83 |
| Example 2 | 1.6 | 6.4 | Pre-mixed | 21.25 | 0.9 | 4.37 |
| Example 3 | 1.6 | 6.4 | Pre-mixed | 23.0 | 1.11 | 4.41 |

Example 8: Handsheet Comparison—Alkaline Conditions

In this example, various wet strength agents, as described above, were applied to handsheets under alkaline papermaking conditions, and wet and dry tensile properties of the resultant handsheets were evaluated.

In this example, handsheets were prepared using the same procedure described in Example 5, above, except that the stock was adjusted by dilute sodium hydroxide solution to a pH of 8.

In this example, the strength aid treatments included a combination of glyoxalated polyacrylamide (GPAM) dry strength resin (Baystrength® 3000, 7.5% solids, available from Kemira Chemicals) dry strength resin, and a PAE booster of Examples 1-4 above. As identified in Table 3 below, some samples were pre-mixed, and in others, the GPAM and PAE were added sequentially. For the premixed combinations, the GPAM was mixed with non-diluted boosters in the amounts identified in Table 3 below, for 10 minutes at the room temperature. Each treatment sample was diluted to a 1% solution. The handsheets were prepared with addition of the 1% solution.

TABLE 3

Handsheet Performance - GPAM with PAE Boosters - Alkaline Papermaking pH 8

| PAE Booster | Booster Added Rate, lb./ton | GPAM Added Rate, lb./ton | Addition Mode | Dry Tensile lbs./in | Tensile Energy Absorbed lb. in/in$^2$ | Initial Wet Tensile lbs./in |
|---|---|---|---|---|---|---|
| Example 1 | 1.6 | 6.4 | Sequential | 20.25 | 0.89 | 2.99 |
| Example 2 | 1.6 | 6.4 | Sequential | 18.40 | 0.79 | 2.46 |
| Example 3 | 1.6 | 6.4 | sequential | 17.89 | 0.81 | 2.64 |
| Example 1 | 1.6 | 6.4 | Pre-mixed | 23.47 | 1.21 | 3.45 |
| Example 2 | 1.6 | 6.4 | Pre-mixed | 21.37 | 0.99 | 2.81 |
| Example 3 | 1.6 | 6.4 | Pre-mixed | 19.32 | 0.76 | 3.33 |

The results shown in Tables 2 and 3 indicate a positive contribution to dry and wet strength from the pre-mixed addition mode under both acidic and alkaline papermaking conditions at the same total addition level. Pre-mixing various PAE boosters with GPAM consistently offered higher tensile energy absorption results than sequential addition of two components.

Example 9: GPAM/PAE Under Alkaline Papermaking (pH 7.5) Conditions

In this example, various wet strength agents were applied to handsheets under alkaline papermaking conditions, and wet and dry tensile properties of the resultant handsheets were evaluated.

Handsheets were prepared as described in Example 5, but under alkaline (pH 7.5) papermaking conditions. The various strength aids are described in Table 4 below. This example demonstrated the use of Example 1 as a strength booster for a two component program with GPAM. The results are compared to three industrial standards: (B)) a permanent wet strength PAE resin; (D)) a permanent PAE wet strength resin with 30% solids with the functional promoter of carboxymethyl cellulose; and (A)) GPAM alone.

TABLE 4

Handsheet Performance - Strength Aids - Alkaline Papermaking pH 7.5

| Run No. | Strength Aid/Booster | Strength aid added rate lb./ton | Booster Added Rate, lb./ton | Addition Mode | Dry Tensile lbs./in | Tensile Energy Absorbed lb. in/in2 | Initial Wet Tensile lbs./in |
|---|---|---|---|---|---|---|---|
| 1 | B | 8 | 0 | n/a | 16.87 | 0.86 | 3.04 |
| 2 | D | 7 | 1 | sequential | 16.60 | 0.8 | 3.68 |

TABLE 4-continued

| Handsheet Performance - Strength Aids - Alkaline Papermaking pH 7.5 | | | | | | | |
|---|---|---|---|---|---|---|---|
| Run No. | Strength Aid/Booster | Strength aid added rate lb./ton | Booster Added Rate, lb./ton | Addition Mode | Dry Tensile lbs./in | Tensile Energy Absorbed lb. in/in2 | Initial Wet Tensile lbs./in |
| 3 | A | 10 | 0 | n/a | 19.42 | 1.05 | 3.93 |
| 4 | A + Example 1 | 8 | 2 | pre-mixed | 21.85 | 1.30 | 3.97 |

Example 10: GPAM/PAE Under Acidic Papermaking (pH 5.5) Conditions

In this example, various wet strength agents were applied to handsheets under acidic papermaking conditions, and wet and dry tensile properties of the resultant handsheets were evaluated, and shown in Table 5, below. Handsheets were prepared as described in Example 7, but under acidic (pH 5.5) papermaking conditions. The various strength aids are the same as for Example 9.

TABLE 5

| Handsheet Performance - Strength Aids - Alkaline Papermaking pH 5.5 | | | | | | | |
|---|---|---|---|---|---|---|---|
| Run No. | Strength Aid/Booster | Strength aid added rate lb./ton | Booster Added Rate, lb./ton | Addition Mode | Dry Tensile lbs./in | Tensile Energy Absorbed lb. in/in2 | Initial Wet Tensile lbs./in |
| 1 | B | 8 | 0 | n/a | 17.53 | 0.91 | 3.14 |
| 2 | D | 7 | 1 | sequential | 19.71 | 1.16 | 3.99 |
| 3 | A | 8 | 0 | n/a | 18.9 | 1.01 | 3.91 |
| 4 | A + Example 1 | 7.4 | 0.6 | pre-mixed | 19.86 | 1.17 | 4.15 |

Example 11: GPAM/PAE at Normal and High Dosage Levels

In this example, various wet strength agents were applied to handsheets under acidic papermaking conditions, and wet and dry tensile properties of the resultant handsheets were evaluated, and shown in Table 6, below. Handsheets were prepared as described in Example 7, but under alkaline (pH 7.5) papermaking conditions. The various strength aids are described in Table 6 below. This example demonstrated the benefit of using the resins in the Examples as strength boosters for a two component program with GPAM at a high dosage level against three industrial standards: (B)) a permanent wet strength PAE resin; (E)) the blend of a permanent PAE wet strength resin and GPAM at solids ratio of 25/75; and (A)) GPAM alone.

The resin dosage of 25 lb/ton is typical for high wet strengthened towel machines. As the resin dosage increased to 25#/ton in this example, the exemplary resins overcame Standard B alone and Standard E in dry and initial wet tensile. The Standard B alone and Standard E yielded lower resin retention than the invention due to higher cationic charge. The Standard B alone and Standard E typically require anionic functional promoter to achieve satisfactory resin retention at such high dosage levels.

TABLE 6

| | | Total Chemical (strength aid + booster) Dosage | | | |
|---|---|---|---|---|---|
| | | 8 lb/ton | | 25 lb/ton | |
| Strength Booster | Ratio of Strength Aid/Booster | Dry Tensile lbs./in | Initial Wet Tensile lbs./in | Dry Tensile lbs./in | Initial Wet Tensile lbs./in |
| Example 1 | 75/25 | 19.8 | 3.4 | 24.3 | 5.5 |
| Example 4 | 75/25 | 20.1 | 3.3 | 26.7 | 5.8 |
| Example 5 | 75/25 | 20.2 | 3.4 | 25.3 | 6.0 |
| Example 6 | 75/25 | 21.5 | 3.4 | 29.9 | 6.5 |
| E | 75/25 | 20.1 | 3.5 | 23.7 | 5.4 |
| A | | 18.8 | 3.2 | 23.8 | 5.4 |
| B | | 17.9 | 3.8 | 19.1 | 4.9 |

Example 12: The Comparison of the Example Vs. Comparative Example 1

(A) GPAM and (B) PAE are the same as them in previous examples. Table 7 shows the handsheet evaluation results of the existing commercial products and the blend using Example 1. The blend using Example 1 provided superior performance to GPAM (alone) at pH 5-8.3 and superior performance to Comparative Example 1 (50:50 blend of GPAM and PAE wet strength agent) at pH 5.

TABLE 7

| Sample | Papermaking pH | Dosage (lb/ton) | Dry Tensile (lb/inch) | Tensile Energy Absorbed lb. in/in$^2$ | Initial Wet Tensile lbs./in | Total Residual epi by-Products Content ppm |
|---|---|---|---|---|---|---|
| Comparative Example 1 | 5.0 | 8 | 20.2 | 1.54 | 3.98 | 1895 |
| GPAM | | 8 | 20.73 | 1.40 | 3.97 | 0 |
| 75/25 blend of GPAM with Example 1 | | 8 | 21.99 | 1.55 | 3.88 | <3.5 |
| Comparative Example 1 | 7.0 | 8 | 20.73 | 1.43 | 3.66 | 1895 |
| GPAM | | 8 | 18.10 | 1.0 | 2.62 | 0 |
| 75/25 blend of GPAM with Example 1 | | 8 | 20.93 | 1.49 | 2.98 | <3.5 |
| Comparative Example 1 | 8.3 | 8 | 22.49 | 1.45 | 3.46 | 1895 |
| GPAM | | 8 | 15.83 | 1.0 | 2.67 | 0 |
| 75/25 blend of GPAM with Example 1 | | 8 | 21.24 | 1.35 | 2.96 | <3.5 |

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to significant figures of the numerical value. In addition, the phrase "about 'x' to 'y'" includes "about 'x' to about 'y'".

It should be emphasized that the above-described embodiments are merely possible examples of implementations, and are merely set forth for a clear understanding of the principles of this disclosure. Many variations and modifications may be made to the above-described embodiment(s) of the disclosure without departing substantially from the spirit and principles of the disclosure. All such modifications and variations are intended to be included herein within the scope of this disclosure and protected by the following claims.

We claim at least the following:

1. A paper having improved dry and initial wet strength formed by a method comprising treatment of an aqueous pulp slurry with an aldehyde-functionalized polymer resin and a polyamidoamine epihalohydrin resin, wherein the aldehyde-functionalized polymer resin and polyamidoamine epihalohydrin resin are mixed together prior to being mixed with the pulp slurry, and the polyamidoamine epihalohydrin resin has an azetidinium content of about 80% or less, wherein the polyamidoamine epihalohydrin resin has a solids content of at least 15% before being mixed together with the aldehyde-functionalized polymer resin; wherein the aldehyde-functionalized polymer resin is about 0.01 to 2.5 wt. % of the aqueous pulp slurry, and the polyamidoamine epihalohydrin resin is about 0.01 to 2.5 wt. % of the aqueous pulp slurry.

2. The paper of claim 1, wherein the aldehyde-functionalized polymer resin is glyoxylated polyacrylamide resin and the polyamidoamine epihalohydrin resin is polyamidoamine epichlorohydrin resin.

3. The paper of claim 1, wherein the azetidinium content is about 70% or less.

4. The paper of claim 1, wherein the paper is a paper product that is a dry paper board, a fine paper, a towel, a tissue, or a newsprint product.

5. A method of making a paper having improved dry and initial wet strength, comprising:

introducing to an aqueous pulp slurry an aldehyde-functionalized polymer resin and a polyamidoamine epihalohydrin resin, wherein the aldehyde-functionalized polymer resin and polyamidoamine epihalohydrin resin are mixed together prior to being mixed with the pulp slurry, and the polyamidoamine epihalohydrin resin has an azetidinium content of about 80% or less, wherein the polyamidoamine epihalohydrin resin has a solids content of at least 15% before being mixed together with the aldehyde-functionalized polymer resin; and wherein the aldehyde-functionalized polymer resin is about 0.01 to 2.5 wt. % of the aqueous pulp slurry, and the polyamidoamine epihalohydrin resin is about 0.01 to 2.5 wt. % of the aqueous pulp slurry.

6. The method of claim 5, wherein the aldehyde-functionalized polymer resin is a glyoxylated polyacrylamide resin and the polyamidoamine epihalohydrin resin is a polyamidoamine epichlorohydrin resin.

7. The method of claim 5, wherein the azetidinium content is about 70% or less.

8. The method of claim 5, wherein the resins and/or the pulp slurry have a pH of below about 10.

* * * * *